US011583091B2

(12) United States Patent
Hackmann

(10) Patent No.: US 11,583,091 B2
(45) Date of Patent: Feb. 21, 2023

(54) SEATING FURNITURE

(71) Applicants: GbR mit Hans-Christian Toni Hackmann & Raphael Schneider, Stuttgart (DE); Kubivent Sitz-und Liegepolster GmbH, Urbach (DE)

(72) Inventor: Hans-Christian Toni Hackmann, Ostfildern (DE)

(73) Assignees: GbR mit Hans-Christian Toni Hackmann & Raphael Schneider, Stuttgart (DE); Kubivent Sitz- und Liegepolster GmbH, Urbach (DE)

( * ) Notice: Subject to any disclaimer, the term of this patent is extended or adjusted under 35 U.S.C. 154(b) by 24 days.

(21) Appl. No.: 16/967,754

(22) PCT Filed: Feb. 6, 2019

(86) PCT No.: PCT/EP2019/052878
§ 371 (c)(1),
(2) Date: Aug. 6, 2020

(87) PCT Pub. No.: WO2019/154838
PCT Pub. Date: Aug. 15, 2019

(65) Prior Publication Data

US 2021/0037979 A1 Feb. 11, 2021

(30) Foreign Application Priority Data

Feb. 7, 2018 (DE) ..... 10 2018 201 887.1

(51) Int. Cl.
*A47C 7/20* (2006.01)
*A47C 9/00* (2006.01)

(52) U.S. Cl.
CPC . *A47C 7/20* (2013.01); *A47C 9/00* (2013.01)

(58) Field of Classification Search
CPC .. A47C 7/18; A47C 7/185; A47C 5/12; A47C 3/16; A47C 7/20; A47C 27/15; A47C 5/125
(Continued)

(56) References Cited

U.S. PATENT DOCUMENTS 9,456,696 B2 * 10/2016 Lee ..... A47C 7/18
10,034,549 B1 * 7/2018 Basques ..... A47C 5/125
(Continued)

FOREIGN PATENT DOCUMENTS

DE 1952162 U1 12/1966
DE 1504258 A1 10/1969
(Continued)

OTHER PUBLICATIONS

European Patent Office/ISA; International Search Report dated May 7, 2019 (16 pages).
(Continued)

*Primary Examiner* — Sarah B McPartlin
(74) *Attorney, Agent, or Firm* — Duane Morris LLP

(57) ABSTRACT

The invention relates to an item of seating furniture, which comprises at least one seat (1,21) in the manner of a seat pedestal (1) or in the manner of a stool and also at least one seat cushion (5). The seat has a hard core (22) and a soft outer layer (23-26), wherein the hard core is preferably composed of at least one hard foam plastic and the outer layer is preferably composed of at least one soft foam plastic. The seat cushion has a filling of microspheres composed of hard foam plastic and having a diameter of less than 2 mm.

21 Claims, 2 Drawing Sheets

(58) Field of Classification Search
USPC ..... 297/452.26, 452.27
See application file for complete search history.

(56) References Cited

U.S. PATENT DOCUMENTS

| | | | | |
|---|---|---|---|---|
| 10,201,764 | B2 * | 2/2019 | Oh | A63H 33/04 |
| 2008/0292830 | A1 * | 11/2008 | Greer | A47C 5/12 428/71 |
| 2016/0367032 | A1 | 12/2016 | Lee | |

FOREIGN PATENT DOCUMENTS

| | | | |
|---|---|---|---|
| DE | 20007630 | U1 | 8/2000 |
| DE | 202006018468 | U1 | 3/2007 |
| DE | 202015104535 | U1 | 11/2015 |

OTHER PUBLICATIONS

German Patent Office; Office Action dated Jan. 24, 2019 in Priority Appln. No. DE102018201887.1.
Dawanda Kanat; DaWanda Nahanleitung: Sitzkissen nahen; https//twww.youtube.com/user/dawmdad . . . .

* cited by examiner

SEATING FURNITURE

PRIORITY CLAIM AND CROSS-REFERENCE

The present application is a National Stage Application, filed under 35 U.S.C. 371, of International Patent Application No. PCT/EP2019/052878, filed on Feb. 6, 2019, which claims the priority of German Patent Application No. DE 102018201887.1, filed Feb. 7, 2018, which applications are incorporated herein by reference in their entirety.

The invention relates to an item of seating furniture, which comprises at least one seat in the manner of a seat pedestal or in the manner of a stool and also at least one seat cushion.

Items of seating furniture, that is to say chairs, benches, stools or else armchairs or sofas, are already known with very different forms and configurations. In the construction or the design of the items of seating furniture, focus may be placed on different aspects depending on which area of life (for example home, work, and others), and accordingly which use, the corresponding item of seating furniture is provided for.

In contrast to the prior art, the present invention wishes to select an evolutionary approach to the construction and the design of an item of seating furniture, that is to say an approach which takes account of people's evolution. In other words: Which of people's postures and seating positions actually correspond to people's bodily requirements? Which seating positions are "species-appropriate" and healthy?

Proceeding from said novel approach, the object of the invention is to provide an item of seating furniture which particularly corresponds to people's natural requirements, based on their evolutionary development. On said item of seating furniture, the intention is for the user to be able to assume various seating positions which are species-appropriate and healthy for people. In addition, the novel item of seating furniture is intended to be usable in a versatile manner and to make it possible to use the item of seating furniture not only statically but also dynamically. Finally, the novel item of seating furniture is intended to be able to be adapted to different surroundings and areas of life, such that the user need not do without the item of seating furniture in any of their areas of life.

At least said objects are achieved by the item of seating furniture having the features of claim 1. Preferred embodiments of said item of seating furniture are described in dependent claims 2 to 14. Claims 15 and 17, along with their respectively dependent claims 16 and 18, claim essential components of the item of seating furniture according to the invention.

The wording of all of the claims is hereby incorporated expressly into the content of this description by reference.

According to the invention, the novel item of seating furniture comprises at least one seat or seating in the manner of a seat pedestal or in the manner of a stool and also at least one seat cushion. In this case, the seat has a hard core and a soft (in comparison to the core) outer layer, wherein the core is preferably composed of at least one hard foam plastic and the outer layer is preferably composed of at least one soft foam plastic. According to the invention, the seat cushion has a filling of microspheres (beads) composed of hard foam plastic and having a diameter of less than 2 mm.

According to the invention, the term "seat pedestal" is intended to mean that the seat can also be described as a platform which is provided for sitting and on which the user of the seat can assume an (arbitrary) seating position. The term "stool", used in accordance with the invention, is also intended to have a corresponding meaning. As is well known, a stool is a simple item of seating furniture, generally without a backrest, on which the user can likewise assume an (arbitrary) seating position.

According to the invention, the term "seat cushion" encompasses all cushions with a generally bag-like envelope, preferably composed of a fabric which is filled with the microspheres composed of hard foam plastic as claimed in claim 1. The cushion provided in accordance with the invention is used, as described below, to support the seating position on the pedestal-like or stool-like seat.

Although, in principle, many different materials can be used for the core and the outer layer of the seat, the core and the outer layer of the seat are preferably composed of foam plastics (for short: foams). As is well known, a foam (foamed plastic) is a material which is composed of a solid plastic and a gas dispersed therein.

Hard foam plastics are foams which oppose a deformation under compressive loading with a relatively high resistance. This can be attributed, inter alia, to the fact that hard foams are predominantly closed cell. By contrast, the soft foam plastics, which are softer in relation to hard foam plastics, have an open cell structure.

According to the invention, the hard foam plastic used is in particular a polyurethane (PUR/PIR) foam or a polystyrene (PS) foam. As is well known, polyurethane (PUR/PIR) foam is formed by polyaddition of isocyanates with polyether or polyester polyols. In this case, there is a distinction to be made between linear and cross-linked PUR foam.

During the production of PIR foam, in comparison to PUR foam, a higher proportion of isocyanate is employed as raw material. The corresponding differences are readily known to those skilled in the art (chemists).

Polystyrene (PS) foam is a plastic which is available as a result of polymerization of styrene and which is foamed with various production methods to give different polystyrene hard foams. According to the invention, a so-called EPS hard foam can preferably be employed. This expanded polystyrene hard foam is foamed, inter alia, with steam.

The soft foam plastic used in accordance with the invention is preferably a polyurethane (PUR) foam. Said polyurethane foam can, as has already been explained, be produced from isocyanates and polyether polyols, with open cell cross-linking. In particular, the soft foam plastic is a polyurethane (PUR) composite foam. Such composite foams are generally composed of offcuts from the generation of PUR soft foam and also of at least one binder. Said materials are also readily known to those skilled in the art.

To determine the relative firmness of foams (hardness, softness), various parameters such as the volume weight (also called density) or the compression hardness can be used. The volume weight (density) is given in $kg/m^3$ and indicates the weight of a foam block with an edge length of 1 m. The compression hardness is given in kPa. Said compression hardness states how much pressure needs to act on a foam in order to compress it to a certain percentage of its starting height.

In the invention, it is preferred for the core of the seat to be composed of a polystyrene (PS) foam having a density of between 10 and 35 $kg/m^3$ and/or having a compressive stress at 10% compression of ≥30 kPa. Even harder preferred variants of such polystyrene foams can have compressive stresses at 10% compression of ≥90 kPa, in particular of ≥150 kPa.

It is likewise preferred for the outer layer of the seat to be composed of a polyurethane (PUR) foam having a compression hardness (at 40%) ≥15 kPa. In particular, the compression hardness (at 40%) is in this case between 15 and 40 kPa.

The provided filling of the seat cushion, said filling being composed of hard foam plastic microspheres having a diameter of less than 2 mm, ensures the dimensional stability of the seat cushion, particularly under weight loading. The provided small spheres (beads) cannot roll away, such that the seating position assumed by the user is largely maintained.

In this connection, it is further preferred in the invention for the microspheres of the filling of the seat cushion to have a diameter of less than 1.5 mm. In this case, the diameter of the microspheres is in particular between 0.5 mm and 1.5 mm.

In one development, the microspheres of the filling of the seat cushion are in particular composed of EPS hard foam plastic (see explanation above).

According to the invention, the seat provided in the case of the novel item of seating furniture can fundamentally have any desired pedestal-like or stool-like form. As a result, said form of the seat, and thus also the configuration of the item of seating furniture as a whole, can be adapted to the environment for which the item of seating furniture is provided. The size of the seat is also fundamentally not restricted in the invention. Thus, the seat can be provided for use by one person, whether they be a child or an adult, or for use by at least two people, for example by a group of people. It is also possible for completely different cross-sectional areas, for example round, oval or polygonal cross-sectional areas, to be selected for the seat.

According to the invention, it is preferred for the seat to have at least one flat (planar) surface (possibly also with a slight inclination). Said surface is then provided as seating surface for the user.

In such embodiments, a further flat surface which faces away from the first flat surface is preferably provided, with which the seat can then be put down on the ground. This is explained in even more detail in connection with the drawings.

As has already been described, the item of seating furniture according to the invention has a seat with a hard core and a soft (in comparison to the core) or relatively soft outer layer. The (relatively hard) core is firstly used to provide the seat with the necessary stability. Secondly, the core ensures that the user of the item of seating furniture, when assuming a seating position, does not sink (too far) into the seat. The (relatively soft) outer layer is used to increase the seating comfort for the user. The outer layer therefore ensures that the user does not have to sit (exclusively) on the hard core.

In preferred embodiments of the invention, the described functions of the (relatively hard) core and the (relatively soft) outer layer can be utilized even further in that the surfaces of the outer layer, which are provided on the seat (and can be used as seating surface), have different firmnesses. In other words: The outer layer does not have the same softness throughout, but rather has different firmnesses/degrees of hardness (which are naturally still softer compared with the core). In this way, it is possible for the user to select a seating surface, and thus seating position, of differing softness.

The different firmnesses of the soft outer layer for a different seating comfort can for example either be achieved as a result of the use of different soft foam plastics for the corresponding surfaces of the outer layer or as a result of different thicknesses of the same soft foam plastic for different surfaces of the outer layer.

All of these aspects are likewise explained in connection with the drawings.

In one development, it is preferred in the invention for the seat of the item of seating furniture to have the form of a polyhedron. As is well known, a polyhedron is a body which is bounded exclusively by straight surfaces (planes). In the invention, said straight surfaces (planes) can then be at least partially provided as seating surface for the user.

In particular, in the invention, the seat has the form of a cuboid or of a cube. In said corresponding configurations, the flat surfaces can be arranged horizontally in a particularly simple manner and can accordingly be used as seating surface.

If the seat has a cuboid form, the dimensions (edge lengths) a, b, c of the cuboid are in particular between 50 and 130 cm (a), between 50 and 90 cm (b) and between 20 and 50 cm (c). If the cuboidal seat is arranged such that the dimension c can be regarded as the height of the seat, then with the corresponding dimensions of between 20 and 50 cm comfortable seating positions can be realized for all users, from children through to (large) adults. This aspect is also discussed in connection with the drawings.

Preferred dimensions of a cuboidal seat are for example 90 cm (a), 70 cm (b) and 40 cm (c), or 60 cm (a) , 60 cm (b) and 40 cm (c).

According to the invention, it is further preferred for the core of the seat to occupy a comparatively large space within the seat itself. In other words: The volume of the core, in relation to the (total) volume of the seat, should not be too small. This is substantiated by the fact that the (hard) core of the seat provides the necessary stability overall. Accordingly, according to the invention, it is preferred for the volume of the core to be between 40% and 95% of the volume of the seat. Within said range, a proportion by volume of the core between 60% and 90%, in particular between 75% and 85%, (in each case in relation to the total volume of the seat) is further preferred.

According to the invention, the seat can furthermore have an envelope or a cover, which completely envelops the seat. Said cover protects the seat, and in particular the externally arranged outer layer, against damage and/or soiling. The cover, which is generally composed of a fabric, can be fixedly attached or can be detachable, for example by means of a zipper. In the latter case, the cover can then be cleaned or washed and pulled onto the seat again.

In preferred embodiments of the item of seating furniture according to the invention, the seat cushion can have a round or an oval cross-sectional area, that is to say a form such as is known, in principle, from so-called yoga cushions.

In one development, the diameter of the seat cushion, in particular of the seat cushion with round or oval cross-sectional area, is between 20 and 40 cm, preferably between 30 and 35 cm. In this case, the seat cushion can in particular have a height of between 10 and 20 cm.

The microsphere filling of the seat cushion is typically located within an envelope which serves as bottom cover. It is furthermore possible to provide a decorative cover which can be arranged around the bottom cover and which can likewise be of detachable design. Said decorative cover can possibly be composed of the same material as the (outer) cover of the seat. It is also possible for the two covers to have a matching design.

Finally, the item of seating furniture according to the invention can additionally comprise a wedge-shaped part for abutment on the seat. Said part is used primarily as a heel wedge for supporting the feet when a squatting seating position is assumed on the seat. This is explained below. The wedge-shaped part is in this case preferably composed of a hard foam plastic, with reference here being made to the above explanations of said material.

The invention furthermore comprises the described seat or seating in the manner of a seat pedestal or in the manner of a stool. Said seat is characterized in that it has a hard core, preferably composed of at least one hard foam plastic, and a soft outer layer, preferably composed of at least one soft foam plastic.

With respect to the preferred configurations of said seat, reference is expressly made to the above statements in connection with the claimed item of seating furniture.

Finally, the invention comprises the seat cushion described. Said seat cushion is characterized in that it has a filling of microspheres (beads) composed of hard foam plastic and having a diameter of less than 2 mm.

With respect to the preferred configurations of said seat cushion, reference is expressly made to the above description in connection with the item of seating furniture according to the invention.

The item of seating furniture according to the invention, with its combination of the seat described and the seat cushion described, is associated with a whole series of advantages. These advantages also come into effect, at least partially, with the two components of the item of seating furniture on their own.

For instance, the (relatively hard) core of the seat firstly ensures that the seat has sufficient stability, inter alia against deformation during use. Secondly, the core provides a comparatively hard and thus stable bearing surface for the user, said bearing surface supporting the user in their selected seating position.

At the same time, the (relatively soft) outer layer provides the user with improved seating comfort, which the user would not have if they assumed a seating position directly on the core. The combination of core and outer layer is thus a vital element for sitting on the seat in a healthy manner.

The seat cushion, with its microsphere filling providing dimensional stability, is used to support the seating position selected by the user on the seat and thus likewise contributes to the sought-after healthy sitting. This support is required especially for users who cannot, or cannot yet, assume certain seating positions on the seat over a longer period of time.

These advantages also arise in connection with the following description, in which several seating positions which can be assumed on the item of seating furniture according to the invention are described. Said seating positions can, in principle, be assumed in all embodiments of the invention. However, they come into effect in particular in the embodiment which is illustrated in the drawings.

Evolutionarily, the deep squat, heel sit, cross-legged, and straddle sit seating positions are particularly healthy for people. These four basic positions can be assumed with the item of seating furniture according to the invention as follows:

1. Deep squat

The user squats on the seat. To this end, both feet are placed approximately hip width apart on a substantially flat and horizontally arranged surface of the seat. In the ideal case, the heels are in this case intended to touch the seating surface. The buttocks are lowered as far as possible, and the upper body remains as upright as possible.

For users who cannot (yet) lower all the way to the heels, a heel wedge can be placed underneath. Furthermore, in order to support said squat, use can be made of the seat cushion, which can for example be laid between the legs, under the buttocks, and thus makes the deep squat seating position significantly easier.

2. Heel sit

In this seating position, the user initially assumes a kneeling position on a flat, horizontally arranged surface. The buttocks are then lowered onto the heels. The insteps in this case lie, just like the lower legs, on the seat.

Here, the seat cushion can likewise be laid under the buttocks in order to achieve a more comfortable seating position for the user.

3. Cross-legged

Here, the user sits cross-legged on a flat, horizontally arranged surface of the seat. This means that the legs or lower legs are crossed in front of the body.

In the event that the user finds this seating position to be too uncomfortable, the seat cushion can be laid under the buttocks. As a result of the higher seating position which is achieved, the cross-legged position becomes more comfortable.

4. Straddle sit

Here, the user sits only with their buttocks (and possibly the thighs) on a flat and horizontally arranged surface of the seat. The legs are spread outward and the feet are placed down on the ground in front of the seat. Here, the user thus sits on the seat like on a (normal) stool.

All four of the seating positions which have been outlined and described can additionally be executed in a variety of variations.

As already mentioned, the seat is used to assume a corresponding healthy seating position. The seat cushion is used either to be able to assume said seating position in a more comfortable manner or to be able to assume said seating position for longer (depending on the mobility or state of health of the user). The seat cushion leads to a significant relief from loading of the user's knee and ankle joints in particular.

A further advantage of the item of seating furniture according to the invention and of the seat according to the invention is also apparent in their use when working at a desk, in particular in a standing position. Here, the initial situation is that, at present, a lot of workplaces are already furnished with height-adjustable desks; however, said desks are still all too seldom used in their standing function.

Here, this can be remedied by the item of seating furniture according to the invention and the seat according to the invention. Firstly, it is possible for the seat, in a suitable arrangement with a comparatively lower height, to be pushed partially under the desk. The user can then place a foot onto the seat, and in this case also alternate the placed-down foot. This makes it possible to stand at the desk, with a propped-up foot, in a variable and dynamic manner.

Furthermore, a suitably configured seat, in particular in cuboid form, can be placed on its end and then used similarly to a bar stool for sitting in front of the desk. As a result, working at the desk in a standing position is made significantly easier and accordingly the inhibition to use the standing function of the desk is lowered.

Further features and advantages of the invention emerge from the following description of a preferred embodiment of the invention in conjunction with the drawings. In this case, the individual features of the invention can in each case be implemented on their own or in combination with one another. The following description serves merely for the further explanation of the invention, without restricting the invention to the disclosure content of said description and the drawings.

In the drawings:

FIGS. 1A and 1B show the combination of a seat 1 and a seat cushion 5, which together form the item of seating furniture according to the invention.

Figure 1A:
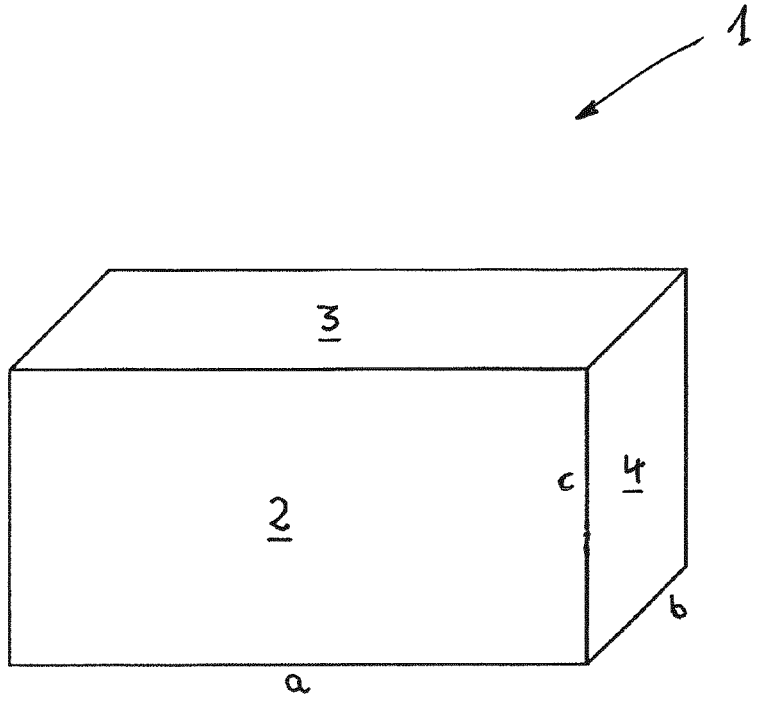
FIG. 1A and FIG. 1B show the schematic illustration of a preferred embodiment of the item of seating furniture according to the invention with seat (FIG. 1A) and seat cushion (FIG. 1B)

As per FIG. 1A, the seat 1 has the form of a cuboid with the edge lengths a, b and c. As a result of the selection of said form, a total of six flat surfaces which are opposite one another in pairs are configured on the seat 1, all six of which can be utilized as seating surface. The three different surfaces, of which in each case two are provided, are identified in FIG. 1A with the reference designations 2, 3 and 4.

The dimensions of the seat 1 and the inner construction of the seat 1 composed of core and outer layer are not illustrated in any more detail in FIG. 1A. To this end, reference is made to FIG. 2. As explained in the description, the seat 1 can be enveloped by a cover, which protects the outer layer in particular against damage and soiling.

Figure 1B:
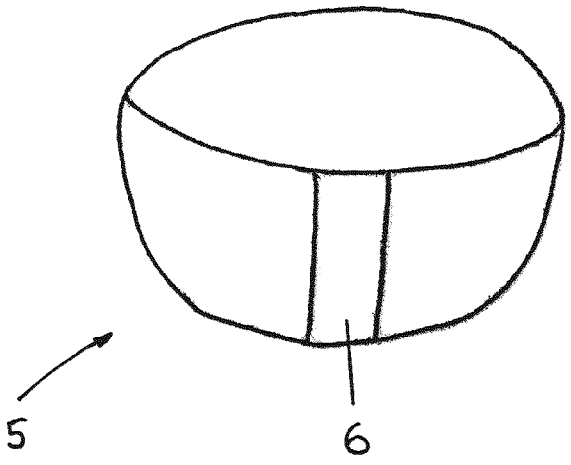

The further constituent part of the item of seating furniture according to the invention, namely the seat cushion 5, is illustrated in FIG. 1B. Said seat cushion 5 has a microsphere filling which is not illustrated in FIG. 1B. Said microspheres are composed of hard foam plastic and have a diameter of less than 2 mm. The seat cushion 5 is not illustrated true to scale in relation to the seat 1 from FIG. 1A. It has dimensioning which is customary for seat cushions, in particular having a diameter of the oval cross-sectional area of between 20 and 40 cm. The height of said cushion is between 10 and 20 cm.

The seat cushion also has an (outer) cover, which is not illustrated in any more detail in FIG. 1B. However, FIG. 1B shows a handle/a strap 6, by means of which the seat cushion can be transported more easily.

Figure 2:
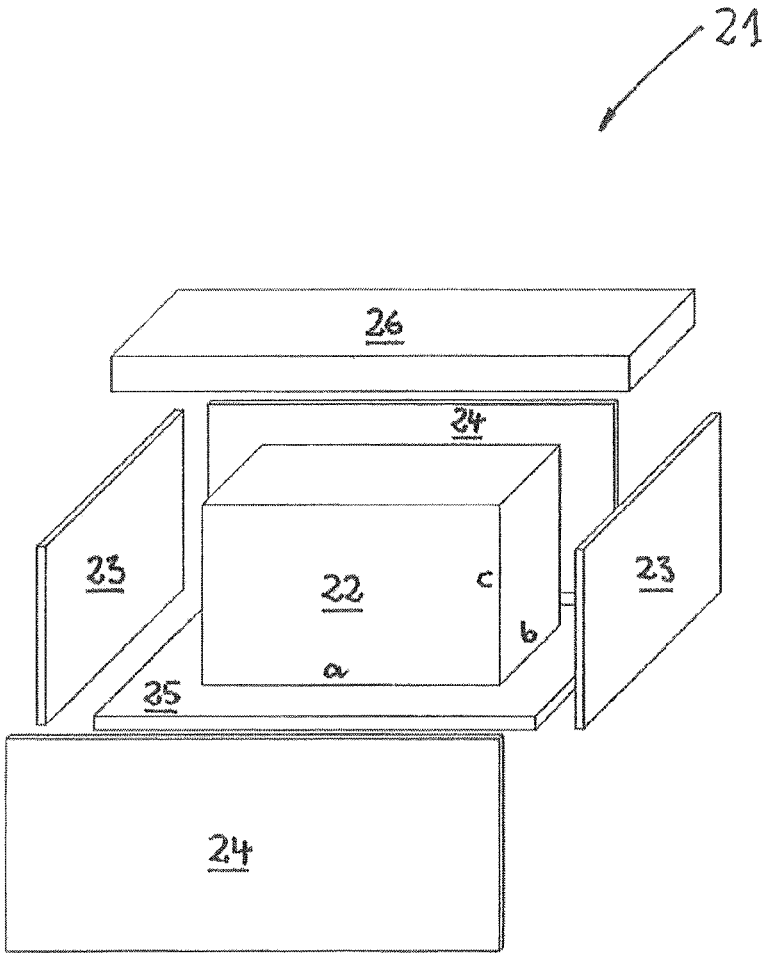
FIG. 2 shows an exploded-style schematic illustration of a preferred embodiment of a seat according to the invention.

FIG. 2 shows the inner construction of a seat 21 according to the invention, which is a constituent part of an item of seating furniture according to the invention.

In this connection, the seat 21 has a core 22 composed of a polystyrene hard foam. The material used is a predominantly closed cell, hard foam.

The edge lengths of the core 22 lie within the ranges specified in claim 11. In the case which is illustrated, preference is given to edge lengths of 88 cm (a) , 68 cm (b) and 36 cm (c).

The outer layer of the seat 21, said layer not being designated in any more detail in FIG. 2 and being provided with its outer surfaces, and possible seating surfaces, around the core 22, is formed by the elements 23, 24, 25 and 26 in the case illustrated in FIG. 2. Said elements are composed of a soft foam plastic, namely a polyurethane (PUR) composite foam. Said composite foam has a substantially lower firmness (hardness) than the hard foam plastic which is used for the core 22.

The panel-shaped elements 23, 24, 25 and 26 are assigned, with the corresponding dimensions, to the side surfaces of the core 22, and can be adhesively bonded for example to the outer surfaces of the core 22. With regard to the abovementioned preferred size of the core 22, the panel elements 23 accordingly have the surface dimensions 68 cm×36 cm, the panel elements 24 the surface dimensions 90 cm×36 cm and the panel elements 25 and 26 the surface dimensions 90 cm×70 cm.

As FIG. 2 shows, the panel element 26 has a greater thickness than the rest of the panel elements. In the preferred case which is illustrated, the panel elements 23, 24 and 25 have a thickness of 1 cm, and the panel element 26 has a thickness of 3 cm. As a result of the greater thickness of the panel element 26, the situation is achieved whereby the flat (bearing) surface, which is formed by said panel element and which can be used as seating surface for the user of the seat 21, has a lower firmness than the rest of the seating surfaces of the seat 21. The seating surface formed by the panel element 26, as a result of the greater thickness of said surface, is thus softer than the rest of the seating surfaces, in the case of which only a 1-cm-thick outer layer of the seat 21 is provided above the hard core 22.

As per FIG. 2, a seat according to the invention, as per FIG. 1A, is thus produced with (overall) dimensions of 90 cm (a), 70 cm (b) and 40 cm (c).

As FIG. 2 shows in a very general manner, the volume occupied by the core 22 within the seat 21 is relatively large. With the preferred dimensions which have been expressly mentioned, the proportion by volume of the core 22 in relation to the total volume of the seat 21 is 85%.

On a seat 1 or 21 which is illustrated in FIGS. 1A and 2, a user can assume the deep squat, heel sit, cross-legged, and straddle sit seating positions, mentioned in the description, in a preferred manner. To this end, depending on the size or preference of the user, the cuboidal seat is placed on one of its side surfaces, and the seating position is assumed on the horizontal seating surface which then lies opposite. In this case, it is possible for the user, inter alia, to select whether they sit down on a softer side surface or on a less soft one.

The invention claimed is:

1. An item of seating furniture, comprising at least one seat configured in a manner of a seat pedestal or a stool and at least one seat cushion, wherein the seat has a core composed of at least one hard foam plastic, and an outer layer in a form of a soft foam plastic extending all sides of the core, the seat has a shape of cuboid or cube having a top surface, and the top surface is flat, the core has a volume between 40% and 95% of a volume of the seat, and the seat cushion has a filling of microspheres composed of a hard foam plastic and having a diameter of less than 2 mm, wherein the seat has at least two flats surfaces for use as seating surface, and the at least two flat surfaces for use as seating surface have at least two different hardness.

2. The item of seating furniture of claim 1, wherein the at least one hard foam plastic in the core is a polyurethane (PUR/PIR) foam or a polystyrene (PS) foam.

3. The item of seating furniture of claim 1, wherein the at least one soft foam plastic is a polyurethane (PUR) foam or a polyurethane (PUR) composite foam.

4. The item of seating furniture of claim 1, wherein the core of the seat is composed of a polystyrene (PS) foam having a density p of between 10 and 35 kg/m$^3$ and/or having a compressive stress at 10% compression of ≥30 kPa.

5. The item of seating furniture of claim 1, wherein the outer layer of the seat is composed of a polyurethane (PUR) foam having a compression hardness (at 40%)≥15 kPa.

6. The item of seating furniture claim 1, wherein the microspheres of the filling of the seat cushion have a diameter of less than 1.5 mm.

7. The item of seating furniture of claim 1, wherein the microspheres of the filling of the seat cushion are composed of EPS hard foam plastic.

8. The item of seating furniture of claim 1, wherein the seat is a cuboidal seat and its dimensions (edge lengths) a, b, c are between 50 and 130 cm (a), between 50 and 90 cm (b) and between 20 and 50 cm (c).

9. The item of seating furniture of claim 1, wherein the volume of the core is between 60% and 90% of the volume of the seat.

10. The item of seating furniture of claim 1, wherein the seat cushion has a round or an oval cross-sectional area.

11. The item of seating furniture of claim 1, wherein the seat cushion has a diameter between 20 and 40 cm, wherein the seat cushion has a height of between 10 and 20 cm.

12. The item of seating furniture of claim 1, wherein the at least one hard foam plastic in the core is an EPS hard foam.

13. The item of seating furniture of claim 1, wherein the compression hardness (at 40%) is between 15 and 40 kPa.

14. The item of seating furniture claim 1, wherein the microspheres of the filling of the seat cushion have a diameter of between 0.5 mm and 1.5 mm.

15. The item of seating furniture of claim 1, wherein the volume of the core is between 75% and 85% of the volume of the seat.

16. The item of seating furniture of claim 1, wherein the seat cushion has a diameter between 30 and 35 cm.

17. The item of seating furniture of claim 1, wherein the core of the seat has a shape of cuboid or cube, the outer layer of the seat comprises six panels adhesively bonded to the core.

18. The item of seating furniture of claim 17, wherein the six panel includes a top panel, wherein the top panel is thicker than any other panel.

19. The item of seating furniture of claim 1, wherein the seat is sized and configured to enable a user to be positioned a various heights above a supporting surface, and is suitable for different users of different heights.

20. A seating furniture, comprising at least one seat configured in a manner of a seat pedestal and at least one seat cushion, wherein the seat has a core composed of at least one hard foam plastic, and an outer layer in a form of a soft foam plastic extending all sides of the core, the seat has a shape of cuboid or cube having a top surface, and the top surface is flat, the core has a volume between 40% and 95% of a volume of the seat, and the seat cushion has a filling of microspheres composed of a hard foam plastic and having a diameter of less than 2 mm;

wherein the seat has at least two flat surfaces for use as seating surface, the at least two flat surfaces for use as seating surface have at least two different hardness; and wherein the seat has no backrest support above the top surface.

21. The seating furniture of claim 20, wherein the seating furniture has no foot attached with a bottom surface of the seat.

* * * * *